United States Patent [19]

Matsueda

[11] 4,293,082

[45] Oct. 6, 1981

[54] LIQUID DISPENSING STAND WITH COOLING SUPPORT

[75] Inventor: Shinji Matsueda, Yokohama, Japan

[73] Assignee: Nippon Light Metal Co., Ltd., Tokyo, Japan

[21] Appl. No.: 119,436

[22] Filed: Feb. 7, 1980

[30] Foreign Application Priority Data

Feb. 13, 1979 [JP] Japan ..... 54-15883

[51] Int. Cl.[3] ..... B67D 3/00; B65D 5/62

[52] U.S. Cl. ..... 222/131; 222/146 C; 222/185

[58] Field of Search ..... 222/131, 146 C, 181, 222/185

[56] References Cited

U.S. PATENT DOCUMENTS

| | | | |
|---|---|---|---|
| 1,381,341 | 6/1921 | Royster | 222/131 X |
| 1,967,165 | 7/1934 | Vargas | 222/185 X |
| 2,176,988 | 10/1939 | Cameron | 222/185 |
| 2,259,710 | 10/1941 | Stern | 222/185 |
| 2,655,286 | 10/1953 | Barbaro | 222/185 X |
| 3,735,899 | 5/1973 | Rollinson | 222/185 X |

*Primary Examiner*—David A. Scherbel
*Attorney, Agent, or Firm*—Oblon, Fisher, Spivak, McClelland & Maier

[57] ABSTRACT

The liquid dispensing stand comprises a supporting seat member having a central opening, a pair of legs having their upper portions secured to the supporting seat member and a base member to which the lower ends of the legs are secured so as to support the supporting seat member in position through the legs. The supporting seat member is adapted to support thereon a liquid containing vessel in upside-down position so that a liquid dispensing member attached to the mouth piece of the vessel projects downwardly through the central opening of said supporting seat member with an appropriate vertical distance held between the liquid dispensing member of the vessel and the base member thereby permitting the liquid in the vessel to be dispensed. Cooling medium may be located between the supporting seat member and the vessel held thereon in upside-down position and/or on the upper surface of the vessel held in upside-down position on the supporting seat member, and a thermally insulating case in the form of an inverted cup shape may be located on the supporting seat member around the vessel so that the liquid in the vessel can be dispensed therefrom at all times in the cooled state. In storing the stand, the thermally insulating case may be housed in the space between the supporting seat member and the base member so that the space for storing the stand can be made to the minimum.

8 Claims, 4 Drawing Figures

LIQUID DISPENSING STAND WITH COOLING SUPPORT

BACKGROUND OF THE INVENTION

The present invention relates to a liquid dispensing stand, and, more particularly, to a liquid dispensing stand which is adapted to support a vessel containing therein liquid such as beer and refreshing beverages and to easily dispense any desired quantity of the liquid such as beer and refreshing beverages in cooled state from the vessel in any desired time.

Various liquid dispensing stands of the type as described above has been proposed heretofore.

In such liquid dispensing stands, it has been common to utilize a cool keeping case in order to permit beverages to be dispensed from the vessel at an appropriate low temperature.

The prior art liquid dispensing stand is, however, not satisfactory in performance and manipulation thereof and suffers from low efficiency in the cooling effect to the liquid containing vessel.

The present invention aims at avoiding the disadvantages of the prior art liquid dispensing stand.

SUMMARY OF THE INVENTION

It is an object of the present invention to provide a liquid dispensing stand which avoids the disadvantages of the prior art liquid dispensing stand described previously.

Another object of the present invention is to provide a liquid dispensing stand which is simple in construction and inexpensive to manufacture and is adapted to support a liquid containing vessel in cooled state and to easily dispense liquid such as beer and refreshing beverages contained in the vessel into a mug or a cup in any desired time by manipulating a liquid dispensing means such as a handle and a cock attached to the mouth piece of the vessel.

A further object is to provide a liquid dispensing stand of the type described above, wherein the vessel is supported in upside-down position on a supporting seat member supported above a base member by means of legs with the liquid dispensing means of the vessel projecting downwardly through the supporting seat member at an appropriate distance spaced from the base member so that liquid in the vessel can be easily dispensed into a mug or a cup located on the base member beneath the liquid dispensing means.

Further objects and advantages of the present invention will be apparent from the following description of the preferred embodiments of the present invention and the accompanying drawings illustrating the same.

BRIEF DESCRIPTION OF THE DRAWINGS

With reference to FIGS. 1 and 2 showing the first embodiment of the liquid dispensing stand of the present invention, the liquid dispensing stand comprises a base member 1 and a pair of supporting legs 2. Each of the legs 2 comprises a pair of substantially parallely arranged strip members 2*a*. The lower ends of the strip members 2*a* are bent so as to be further spaced apart from each other and the bent portions 2*b* of the lower ends of the strip members 2*a* are secured to the base member 1 by a securing rod 3 passing through the bent portions 2*b* and the base member 1. To this end, the base member 1 is formed with notches 1*a* outside of the bent portions 2*b* adjacent thereto so as to present surfaces 1*b* through which a hole can be easily drilled into the base member 1 for inserting the rod 3.

As shown in FIG. 2, the base member 1 is formed with a lower shallow circular recess 1*c* for reducing unnecessarily superfluous weight of the base member 1 as well as an upper shallow circular recess 1*d* the purpose of which will be set forth later.

Figure 1:
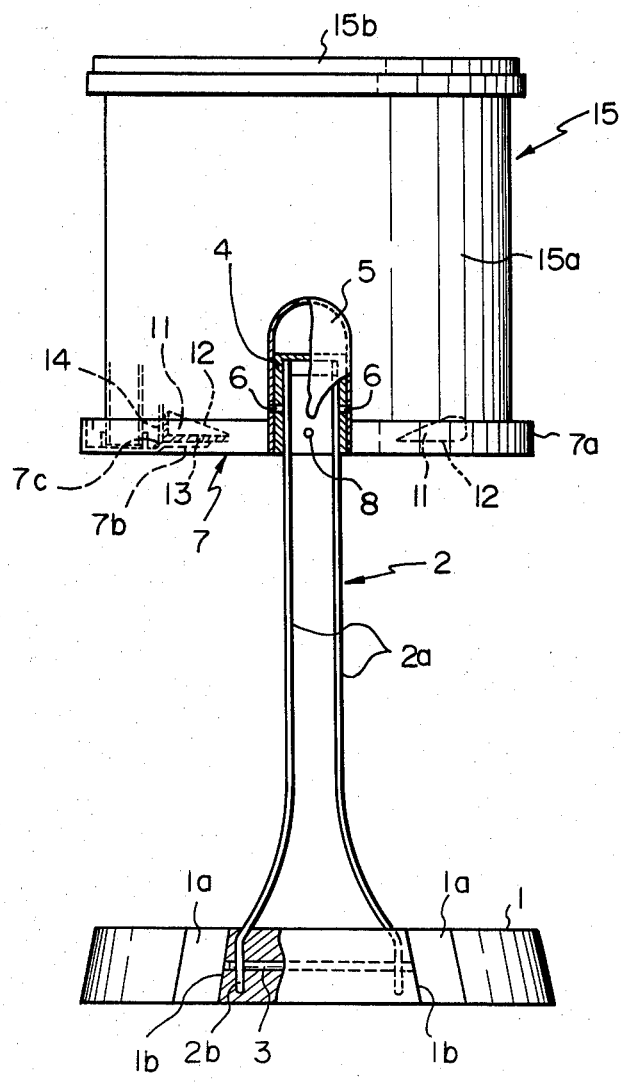
FIG. 1 is a side view partly in cross-section showing a first embodiment of the liquid dispensing stand constructed in accordance with the present invention.

Referring again to FIG. 2, it will be seen that the pair of legs 2 are arranged at diametrically opposite positions in the peripheral portion of the base member 1.

A fixing member 4 and a cover member 5 mounted thereon are secured around the upper ends 2*c* of the strip members 2*a* forming the respective leg 2 by means of a securing pin 6. The surface 4*a* is concave or part-cylindrical, so that the upwardly curled outer peripheral edge 7*a* of a supporting seat member 7 snugly fits with the concave surface 4*a* of the fixing member 4, thus the fixing member 4 is rigidly secured to the peripheral edge 7*a* of the supporting seat member 7 by means of a securing pin 8, thereby permitting the supporting seat member 7 to be supported through the legs 2 by the base member 1 in position above the same in spaced relationship thereto as shown in FIG. 2.

Figure 2:
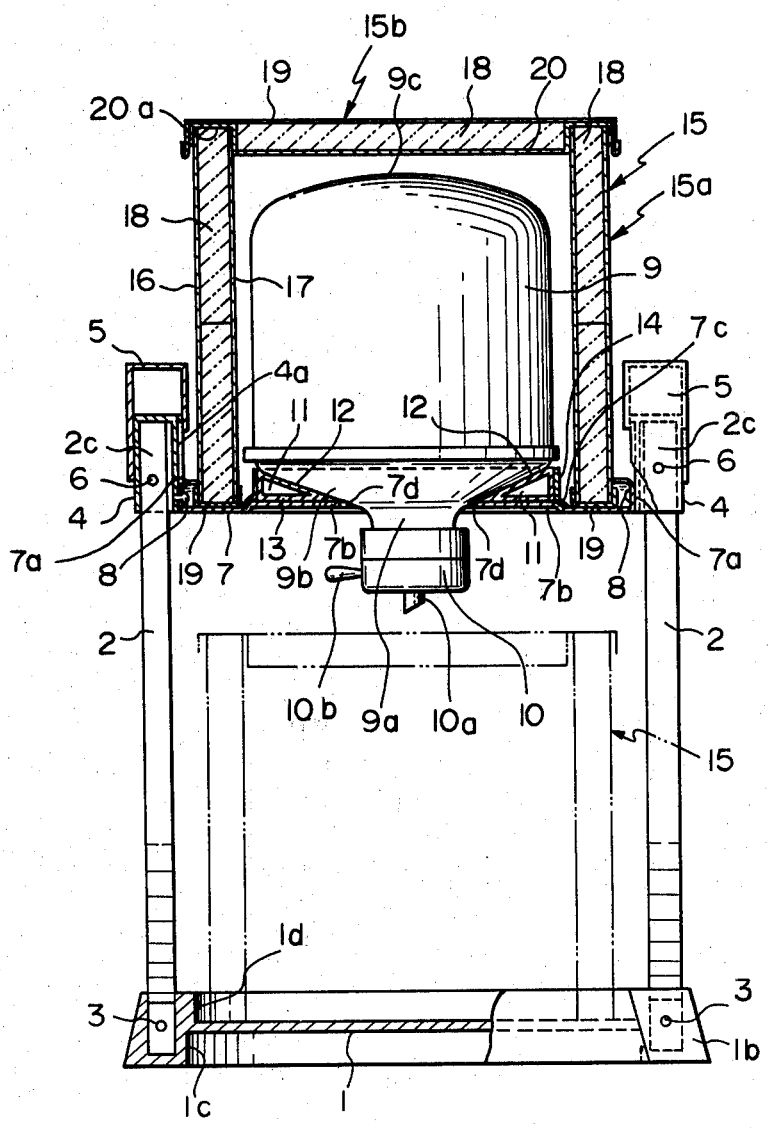
FIG. 2 is a front elevational view of FIG. 1 with a portion shown in cross-section.

As shown in FIG. 2, the supporting seat member 7 is made of a thin plate preferably of a metal such as aluminum and a shallow circular recess 7*b* is formed at the lower surface thereof so as to form a circular beveled edge 7*c* on the upper surface of the support seat member 7 the purpose of which will be described later. The supporting seat member 7 is also provided with a central opening 7*d* the purpose of which will be described later.

In accordance with the present invention, a vessel 9 containing therein liquid such as beer and refreshing beverages is located on the supporting seat member 7 in upside-down position as shown in FIG. 2 so that the mouth piece 9*a* of the vessel 9 mounting thereon a liquid dispensing mechanism 10 projects downwardly through the central opening 7*d* of the supporting seat member 7 with an appropriate distance held between the liquid dispensing mechanism 10 and the base member 1 so that a mug or a cup may be located on the base member 1 beneath the liquid dispensing mechanism 10.

The liquid dispensing mechanism 10 comprises a liquid discharge tube 10*a* and a manipulating handle 10*b* for dispensing liquid from the vessel into the mug or the cup by any desired quantity by manually operating the handle 10*b*. An air inlet tube (not shown) may be provided in the liquid dispensing mechanism 10 extending through the mouth piece 9*a* upwardly above the level of the liquid in the vessel 9 in order to permit the liquid to be dispensed without being excessively sparkled or bubbled because of the reduction in pressure caused during the dispensing of liquid in case the air inlet tube is not provided.

In accordance with the present invention, cooling medium 11 such as ice, dry ice and commercially solid cooling agent is located between the shoulder portion 9*b* of the vessel 9 and the supporting seat member 7. In order to facilitate the location of the cooling medium 11 in position, it may be put in an annular bag 12, and a shallow cup-shaped annular thermally insulating member 13 is provided on the supporting seat member 7 for supporting the cooling medium 11 in the bag 12. A ring member 14 engaging with the circular beveled edge 7*c* of the supporting seat member 7 serves to locate the thermally insulating member 13 and the cooling medium 11 in the bag 12 in position.

Alternatively, the cooling medium may be located on the bottom surface 9*c* of the vessel 9 now facing upwardly as shown in FIG. 2 or the cooling medium may be located on the bottom surface 9*c* together with interposition of the cooling medium between the shoulder portion 9*b* of the vessel 9 and the supporting seat member 7.

Thus, the vessel 9 and the liquid therein can be cooled to an appropriate low temperature thereby permitting liquid to be taken by users very comfortably.

In order to efficiently maintaining cold thus generated by the cooling medium, a cool keeping case 15 in the inverted cup-shape is located on the supporting seat member 7 around the vessel 9.

The cool keeping case 15 comprises a cylindrical trunk member 15*a* and a cover member 15*b* fitted on the upper end of the trunk member 15*a*.

As seen in FIG. 2, the trunk member 15*a* includes an outer cylindrical wall member 16, an inner cylindrical wall member 17 concentric thereto and a thermally insulating material 18 such as foamed styrene and foamed urethane filled in the space between the outer wall member 16 and the inner wall member 17. The thermally insulating foamed material 18 may be comprised of many unitary blocks or it is formed by pouring the foamable synthetic resin material into the space between the outer and the inner wall member 16, 17. The lower end of the trunk member 15*a* is covered by an annular protecting channel member 19 having an inverted U-shape in cross-section as shown in FIG. 2.

In like manner, the cover member 15*b* comprises an outer wall member 19, an inner wall member 20 having an annular recess 20*a* snugly fitting with the upper edge of the trunk member 15*a* and the thermally insulating material 18 filled in the space between the outer and the inner wall member 19, 20.

Thus, the cold generated by the cooling medium 11 can be efficiently maintained by locating the cool keeping case 15 around the vessel 9.

When the stand described above is to be stored, the cool keeping case 15 is removed from the supporting seat member 7 and located on the recess 1*d* of the base member 1 as shown in the phantom line in FIG. 2, so that the height of the stand is widely reduced to facilitate the storage of the stand.

Figure 3:
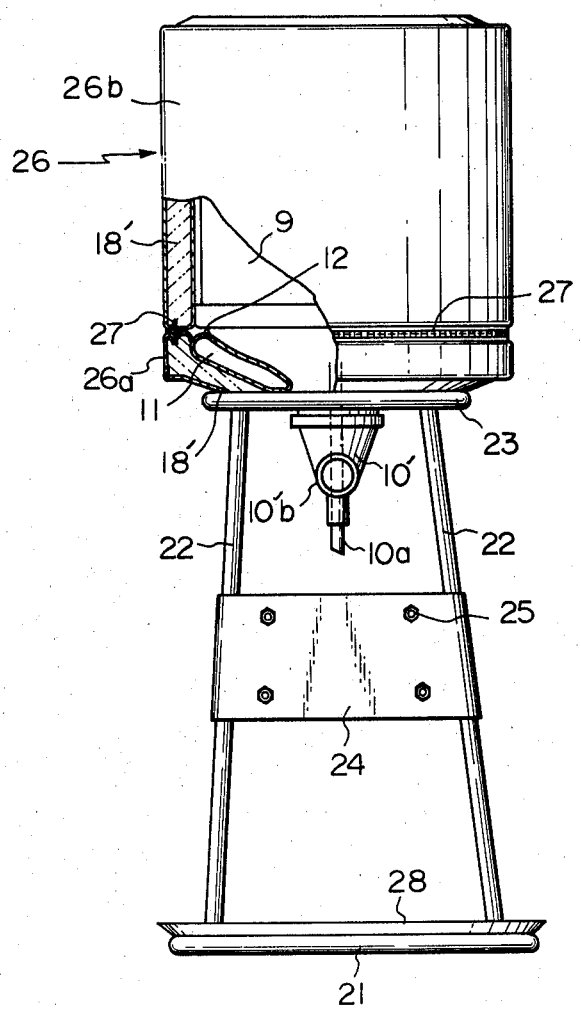
FIG. 3 is a rear elevational view partly in cross-section showing another embodiment of the present invention.
Figure 4:
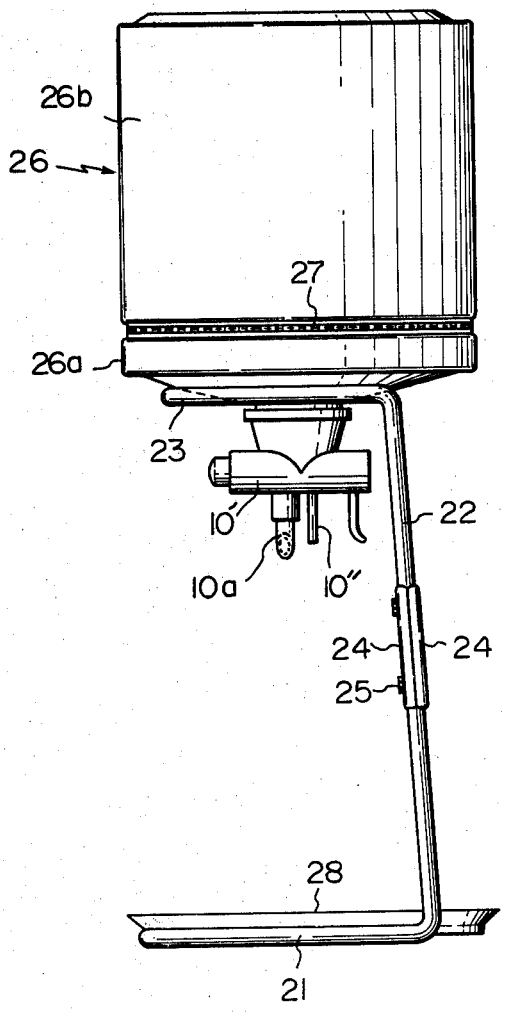
FIG. 4 is a side view of FIG. 3.

FIGS. 3 and 4 show another embodiment of the present invention. In the embodiment shown in FIGS. 3 and 4, the base member 21, the legs 22 and the supporting seat member 23 are formed integrally by a single elongated rod member preferably a hollow cylindrical metallic member such as aluminum by appropriately bending the rod member so as to form the part-circularly bent base member 21 and the part-circularly bent supporting seat member 23 connected by a pair of straight legs 22 to the base member 21. In order to stiffen the legs 22, a pair of connecting plates 24 are provided which span the legs 22 at intermediate position thereof and sandwitch the legs 22 and are firmly clamped by means of bolt-nut means 25.

The cool keeping case 26 comprises a double walled flexible thermally insulating base member 26*a* filled with sponge-like or cotton-like thermally insulating material 18' within the space between the double walls thereof and an inverted cup-shaped double walled flexible thermally insulating trunk member 26*b* filled with the thermally insulating material 18' within the space between the double walls thereof as shown in FIG. 3.

The upper edge of the base member 26*a* and the lower edge of the trunk member 26*b* may be connected together by connecting means 27 such as a slide fastener.

In use, the cooling medium containing bag 12 is interposed between the vessel 9 and the base member 26*a* so as to cool the vessel 9 and the liquid therein, while the cool keeping case 26 prevents cold generated by the cooling medium 11 from being dissipated from the stand.

The liquid dispensing mechanism 10' shown in FIGS. 3 and 4 comprises a liquid discharge tube 10*a* , an air inlet tube 10'', and a manipulating knob 10'*b*. The function of the mechanism 10' is similar to that shown in FIG. 1.

In order to facilitate the location of the mug or the cup beneath the liquid dispensing mechanism 10', a dish member 28 may be secured on the base member 21.

Although the above described stand may be preferably made of a light metal such as aluminum, it is also possible to make the stand from a plastic material or other material suitable for making the stand.

The operation of the above described liquid dispensing stand is as follows.

In use, the vessel 9 is located on the supporting seat member 7 or 23 in inverted or upside-down position so that the liquid dispensing mechanism 10 or 10' projects downwardly through the supporting seat member 7 or 23. The cooling medium 11 is interposed between the vessel 9 and the supporting seat member 7 or the supporting seat member 23, in latter case the base member 26*a* being also interposed between the cooling medium 11 and the supporting seat member 23.

Cooling medium 11 may be also located on the bottom surface of the inverted vessel 9.

Then the cool keeping case 15 is located around the vessel 9 or the trunk member 26*b* is joined to the base member 26*a*.

In order to dispense the cooled liquid such as beer or refreshing beverage, it is only necessary to locate a mug or a cup beneath the liquid dispensing mechanism 10 or 10' and manipulate the handle 10*b* or the knob 10'*b* thereby permitting liquid to be dispensed in any desired quantity from the vessel 9 into the mug or the cup.

In storing the stand, the cool keeping case 15 or 26 may be housed in the space between the supporting seat member 7 and the base member 1 so as to reduce the size of the stand.

What is claimed as new and desired to be secured by Letters Patent of the United States is:

1. Liquid dispensing stand for use with a liquid containing vessel having a mouth piece to which a manual liquid dispensing means is attached, wherein the improvement comprises a supporting seat member having a central opening, a pair of legs having the upper portions thereof secured to said supporting seat member and a base member to which the lower ends of said legs are secured so as to support said supporting seat member in position above said base member by means of said legs, said supporting seat member being adapted to support thereon said liquid containing vessel in upside-down position so that said liquid dispensing means of said vessel projects downwardly through said central opening of said supporting seat member with an appropriate vertical distance held between said liquid dispensing means and said base member thereby permitting the liquid in said vessel to be dispensed in a receiving member located on said base member underneath said liquid dispensing means by operating the same, and cooling medium located between said supporting seat member and said vessel, said cooling medium supporting said vessel and cooling the liquid therein.

2. Liquid dispensing stand according to claim 1, further comprising a thermally insulating case located on said supporting seat member around said vessel, thereby permitting the liquid in said vessel to be dispensed in the cooled state.

3. Liquid dispensing stand according to claim 2, wherein said thermally insulating case comprises a cylindrical thermally insulating trunk member and a thermally insulating cover member detachably mounted on said trunk member, said trunk member being capable of detached from said supporting seat member and located between the space between said base member and said supporting seat member together with said cover member.

4. Liquid dispensing stand according to claim 3, wherein the space between said supporting seat member and said base member is so determined that said thermally insulating trunk member can be housed in said space together with said thermally insulating cover member for reducing the height of said stand when the same is in stored state.

5. Liquid dispensing stand according to claim 1, wherein each of said pair of legs comprises a pair of strip members with their upper portions secured to the periphery of said supporting seat member while the lower ends are secured to said base member.

6. Liquid dispensing stand for use with a liquid containing vessel having a mouth piece to which a manual liquid dispensing means is attached, wherein the improvement comprises a supporting seat member having a central opening, a pair of legs having the upper portions thereof secured to said supporting seat member and a base member to which the lower ends of said legs are secured so as to support said supporting seat member in position above said base member by means of said legs, said supporting seat member being adapted to support thereon said liquid containing vessel in upside-down position so that said liquid dispensing means of said vessel projects downwardly through said central opening of said supporting seat member with an appropriate vertical distance held between said liquid dispensing means and said base member thereby permitting the liquid in said vessel to be dispensed in a receiving member located on said base member underneath said liquid dispensing means by operating the same, further comprising a thermally insulating case located on said supporting seat member around said vessel, wherein said thermally insulating case comprises a flexible thermally insulating base member adapted to be located on said supporting seat member with cooling medium located between said flexible thermally insulating base member and said vessel held thereon which is supported and cooled by said cooling medium, and a flexible thermally insulating trunk member with its upper end closed by a flexible thermally insulating cover portion, said trunk member being detachably connectable to said flexible thermally insulating base member by means of connecting means such as fastener means, said thermally insulating base member having a central opening through which said liquid dispensing means projects downwardly.

7. Liquid dispensing stand according to claim 5, wherein said supporting seat member, said legs and said base member are formed integrally from a continuous rod member with connecting, stiffening means being secured to said legs in the intermediate portions thereof while a dish member is attached on said base member.

8. Liquid dispensing stand according to claim 7, wherein said continuous rod member is a hollow tube member.

* * * * *